US008535172B2

(12) United States Patent
O'Shea, III et al.

(10) Patent No.: US 8,535,172 B2
(45) Date of Patent: Sep. 17, 2013

(54) GOLF CLUB WITH UNIVERSAL HOSEL AND/OR SPACER

(75) Inventors: James O'Shea, III, Carlsbad, CA (US); Ryan L. Roach, Carlsbad, CA (US); Richard Romo Sanchez, Temecula, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 122 days.

(21) Appl. No.: 13/192,987

(22) Filed: Jul. 28, 2011

(65) Prior Publication Data

US 2013/0029777 A1 Jan. 31, 2013

(51) Int. Cl.
*A63B 53/00* (2006.01)

(52) U.S. Cl.
USPC ..... 473/305; 473/288; 473/345

(58) Field of Classification Search
USPC ..... 473/305, 345
See application file for complete search history.

(56) References Cited

U.S. PATENT DOCUMENTS

| | | | | |
|---|---|---|---|---|
| 1,444,842 | A | 2/1923 | Lagerblade | |
| 1,480,056 | A | 1/1924 | Flint | |
| 1,882,509 | A | 10/1932 | Lagerblade | |
| 1,892,482 | A | 12/1932 | Cash, Jr. | |
| 2,039,320 | A | 5/1936 | Kraeuter | |
| 2,452,890 | A | 11/1948 | Wolfram | |
| 3,172,667 | A | 3/1965 | Baker et al. | |
| 4,534,558 | A | 8/1985 | Yoneyama | |
| 4,917,384 | A | 4/1990 | Caiati | |
| 5,335,909 | A | 8/1994 | Green, Jr. | |
| 5,439,218 | A * | 8/1995 | Gondeck | 473/308 |
| 5,505,447 | A | 4/1996 | Mockovak | |
| 5,575,723 | A | 11/1996 | Take et al. | |
| 5,586,944 | A | 12/1996 | Nagamoto et al. | |
| 5,607,363 | A | 3/1997 | Chou | |
| 5,643,105 | A | 7/1997 | Niswander | |
| 5,643,110 | A | 7/1997 | Igarashi | |
| 5,688,186 | A | 11/1997 | Michaels et al. | |
| 5,688,188 | A | 11/1997 | Chappell | |
| 5,769,307 | A | 6/1998 | Takeda | |
| 5,857,922 | A | 1/1999 | Delio | |
| 5,863,260 | A | 1/1999 | Butler, Jr. et al. | |
| 5,906,549 | A | 5/1999 | Kubica | |
| 5,938,541 | A | 8/1999 | Allen et al. | |
| 5,954,596 | A | 9/1999 | Noble et al. | |
| 6,059,670 | A | 5/2000 | Mogan | |
| 6,102,274 | A | 8/2000 | Nagamoto | |
| 6,206,788 | B1 | 3/2001 | Krenzler | |
| 6,257,991 | B1 | 7/2001 | Ortiz | |
| 6,287,214 | B1 | 9/2001 | Satoh | |
| 6,352,482 | B1 | 3/2002 | Jacobson et al. | |
| 6,368,230 | B1 | 4/2002 | Helmstetter et al. | |
| 6,431,993 | B1 * | 8/2002 | Dyer | 473/246 |
| 6,561,919 | B2 | 5/2003 | Edel | |
| 6,620,053 | B2 | 9/2003 | Tseng | |

(Continued)

*Primary Examiner* — Michael Dennis
(74) *Attorney, Agent, or Firm* — Mark S. Leonardo; Brown Rudnick LLP

(57) ABSTRACT

A golf club can include a universal hosel and/or hosel spacer that allows the golf club to be used with a variety of different sized club head shafts. The universal hosel can include multiple steps or ledges, and various inner diameters to accommodate different sized shafts. The spacer can be a self-expanding spacer, and can be pre-coated with epoxy. The spacer can fill in gaps within a hosel, so as to accommodate different sized shafts.

9 Claims, 8 Drawing Sheets

(56) References Cited

U.S. PATENT DOCUMENTS

| | | | | |
|---|---|---|---|---|
| 6,652,391 | B1 | 11/2003 | Kubica et al. | |
| 6,669,573 | B2 | 12/2003 | Wood et al. | |
| 6,679,786 | B2 | 1/2004 | McCabe | |
| 6,817,953 | B2 | 11/2004 | Farmer | |
| 6,855,067 | B2 | 2/2005 | Solheim et al. | |
| 6,887,163 | B2 | 5/2005 | Blankenship | |
| 6,890,269 | B2 | 5/2005 | Burrows | |
| 7,014,568 | B2 | 3/2006 | Pelz | |
| 7,029,402 | B2 | 4/2006 | Nakajima | |
| 7,192,361 | B2 | 3/2007 | Gilbert et al. | |
| 7,201,668 | B1 | 4/2007 | Pamias | |
| 7,207,897 | B2 | 4/2007 | Burch et al. | |
| 7,226,364 | B2 | 6/2007 | Helmstetter | |
| 7,273,418 | B2 | 9/2007 | Gilbert et al. | |
| 7,281,985 | B2 | 10/2007 | Galloway | |
| 7,326,126 | B2 | 2/2008 | Holt et al. | |
| 7,347,796 | B2 | 3/2008 | Takeda | |
| 7,351,159 | B2 | 4/2008 | Lai | |
| 7,377,862 | B2 | 5/2008 | Galloway | |
| 7,413,518 | B2 | 8/2008 | Cole et al. | |
| 7,427,239 | B2 | 9/2008 | Hocknell et al. | |
| 7,553,240 | B2 | 6/2009 | Burnett et al. | |
| 7,594,862 | B2 | 9/2009 | Gilbert | |
| 7,653,980 | B2 | 2/2010 | Vokey et al. | |
| 7,658,685 | B2 | 2/2010 | Vokey et al. | |
| 7,758,449 | B2 | 7/2010 | Gilbert et al. | |
| 7,780,549 | B2 | 8/2010 | Park et al. | |
| 7,803,062 | B2 | 9/2010 | Gilbert et al. | |
| 7,846,037 | B2 | 12/2010 | Burnett et al. | |
| 8,192,299 | B2 * | 6/2012 | Sato et al. | 473/307 |
| 2001/0029208 | A1 | 10/2001 | Takeda | |
| 2004/0018886 | A1 | 1/2004 | Burrows | |
| 2005/0085313 | A1 | 4/2005 | Nishitani | |
| 2005/0096148 | A1 | 5/2005 | Noble et al. | |
| 2007/0135229 | A1 | 6/2007 | Lo et al. | |
| 2007/0173344 | A1 | 7/2007 | Burch | |
| 2008/0045351 | A1 | 2/2008 | Vokey et al. | |
| 2008/0146373 | A1 | 6/2008 | Takeda | |
| 2008/0280693 | A1 * | 11/2008 | Chai | 473/288 |
| 2009/0181792 | A1 | 7/2009 | Burch | |
| 2009/0264217 | A1 | 10/2009 | Johnson et al. | |
| 2009/0286619 | A1 | 11/2009 | Beach et al. | |
| 2009/0305812 | A1 | 12/2009 | Nakamura | |
| 2009/0318243 | A1 | 12/2009 | Golden et al. | |
| 2009/0325727 | A1 * | 12/2009 | Takeuchi | 473/305 |
| 2010/0022323 | A1 | 1/2010 | Thomas et al. | |
| 2010/0029405 | A1 | 2/2010 | Gilbert | |
| 2010/0035701 | A1 * | 2/2010 | Kusumoto | 473/307 |
| 2010/0087270 | A1 | 4/2010 | Ban et al. | |
| 2010/0113180 | A1 | 5/2010 | Nakamura | |
| 2010/0190572 | A1 | 7/2010 | Vokey et al. | |
| 2010/0234123 | A1 | 9/2010 | Sato et al. | |
| 2010/0279791 | A1 | 11/2010 | Park et al. | |
| 2010/0285898 | A1 | 11/2010 | Gilbert et al. | |

* cited by examiner

GOLF CLUB WITH UNIVERSAL HOSEL AND/OR SPACER

BACKGROUND OF THE INVENTION

1. Field of the Invention

This application generally relates to golf clubs, and in particular to universal type hosels and spacers for golf clubs that can be used to accommodate a plurality of different sized shafts.

2. Description of the Related Art

Golf clubs and golf club heads can come in many different forms and makes, such as wood- or metalwood-type (including drivers and fairway woods), iron-type (including wedge-type club heads), utility or specialty-type, and putter-type club heads.

The design and manufacture of golf clubs can require careful attention to club head construction. Among the many factors that can be considered are material selection, material treatment, structural integrity, and overall geometric design, including but not limited to shaft attachment design.

SUMMARY OF THE INVENTION

An aspect of at least one of the embodiments disclosed herein includes the realization that it is becoming more common for golfers to want to use specially sized shafts for their golf clubs. Club head shafts commonly come in three standard tip diameters. These are 0.335 inch (typically used for metal woods ("metals"), 0.350 inch (typically used for metals and hybrids), and 0.370 inch (typically used for irons and wedges). Additionally, some club heads have a tapered tip shaft, having a diameter of approximately 0.355 inch, with a taper rate of 0.0075 in/in over approximately a one inch length. However, with advances in technology, and with a desire for greater precision and performance, club head shafts are becoming more and more optimized for particular golfer needs. For example, some golfers may want to use a particular sized club head shaft for a given club head, while other golfers may want to use a different sized club head shaft for the same club. Similarly, a golfer may want to use a club head shaft size that is not commonly made, and/or may want to use a club head shaft size that is not currently anticipated for use with a particular club head, or particular club head set.

Complicating the problem is that golf club head hosels, which are designed to receive club head shafts, are typically designed to accommodate only a single specific club head shaft size. For example, the hosels of a set of iron clubs may typically accommodate one shaft size, while hosels of a set of woods may accommodate another shaft size. It is difficult to meet the demands of golfers, who want to use various sized club head shafts, when a club head hosel is designed only to meet one specific shaft size.

Overall, therefore, it would be advantageous to have a universal type hosel and/or spacer that can be used to accommodate a variety of different club head shafts. The universal type hosel and/or spacer can be implemented on an iron set, a wood set, a hybrid set, etc., and/or can be implemented as a universal feature on all club heads, such that every type of club head includes the same universal type hosel and/or spacer. The universal type hosel and/or spacer can thus reduce or eliminate the need for the manufacture of a different hosel for every specialized club head shaft.

Thus, in accordance with at least one embodiment, a golf club head can comprise a ball striking face, a sole, a crown, a hosel comprising a first hosel section comprising a first outer diameter, a first inner diameter, and a first length, a second hosel section located below the first hosel section, the second hosel section comprising a second outer diameter, a second inner diameter tapered inwardly from the first inner diameter, and a second length, a third hosel section located below the second hosel section, the third hosel section comprising a third outer diameter, a third inner diameter less than the first inner diameter, and a third length, a fourth hosel section located below the third hosel section, the fourth hosel section comprising a fourth outer diameter, a fourth inner diameter less than the third inner diameter, and a fourth length, the fourth hosel section further comprising a first upper ledge configured to support the end of a club head shaft, a fifth hosel section located below the fourth hosel section, the fifth hosel section comprising a fifth outer diameter, a fifth inner diameter less than the fourth inner diameter, and a fifth length, the fifth hosel section comprising a second upper ledge configured to support the end of a club head shaft, and a third lower ledge configured to support the end of a club head shaft.

In accordance with at least another embodiment, a golf club head can comprise a ball striking face, a sole, a crown, a hosel comprising a hosel body and a hosel opening in the hosel body, a club head shaft having a distal end, the distal end of the club head shaft located within the hosel opening, and a hosel spacer surrounding the distal end of the club head shaft within the hosel opening, the hosel spacer comprising a self-expanding structure within the hosel opening.

BRIEF DESCRIPTION OF THE DRAWINGS

These and other features and advantages of the present embodiments will become more apparent upon reading the following detailed description and with reference to the accompanying drawings of the embodiments, in which.

DETAILED DESCRIPTION OF THE PREFERRED EMBODIMENT

A golf club universal hosel and/or spacer is disclosed herein. The embodiments disclosed herein are described in the context for use with any type of club head, including but not limited to woods, fairways, hybrids, and irons.

Figure 1:
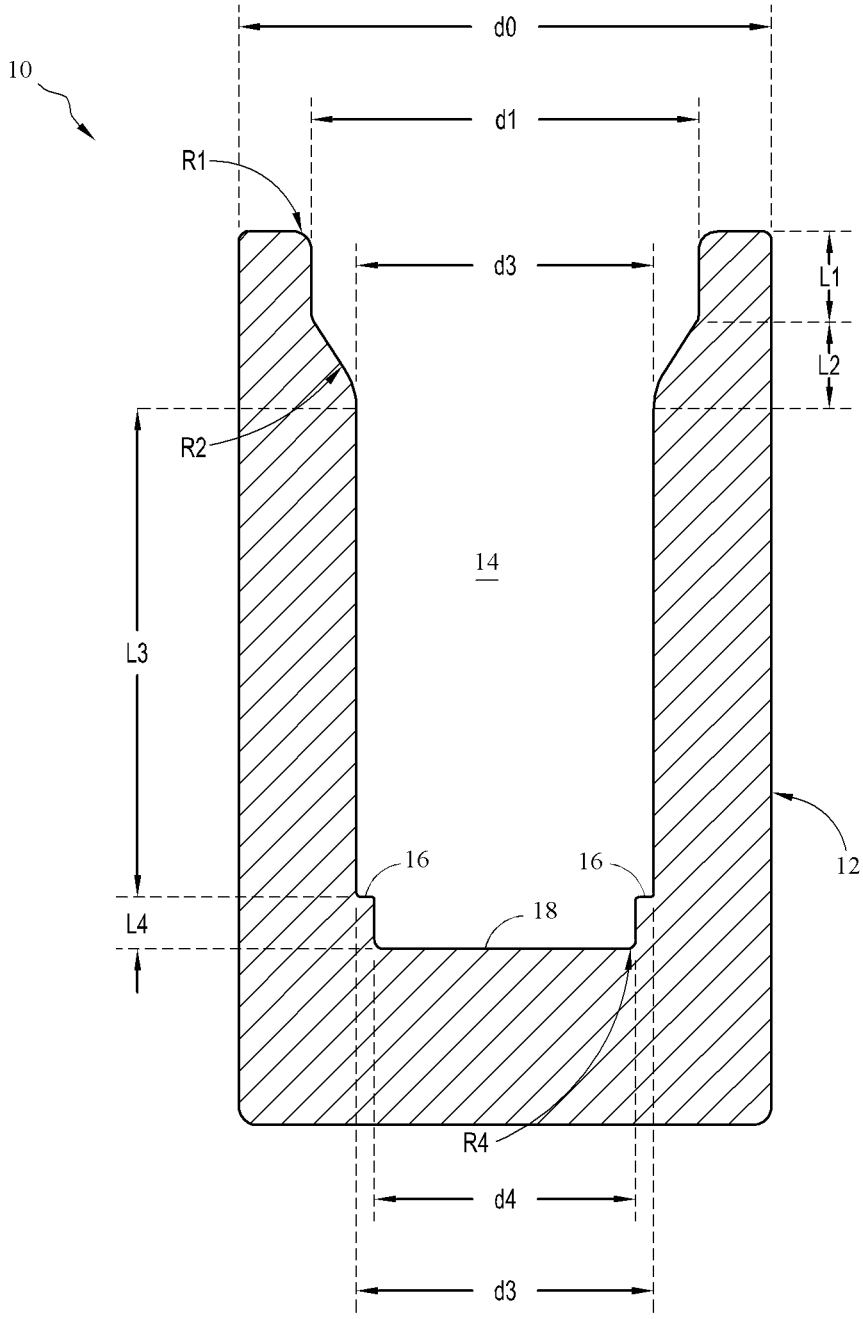
FIG. 1 is a cross-sectional view of a hosel in accordance with at least one embodiment.
Figure 2:
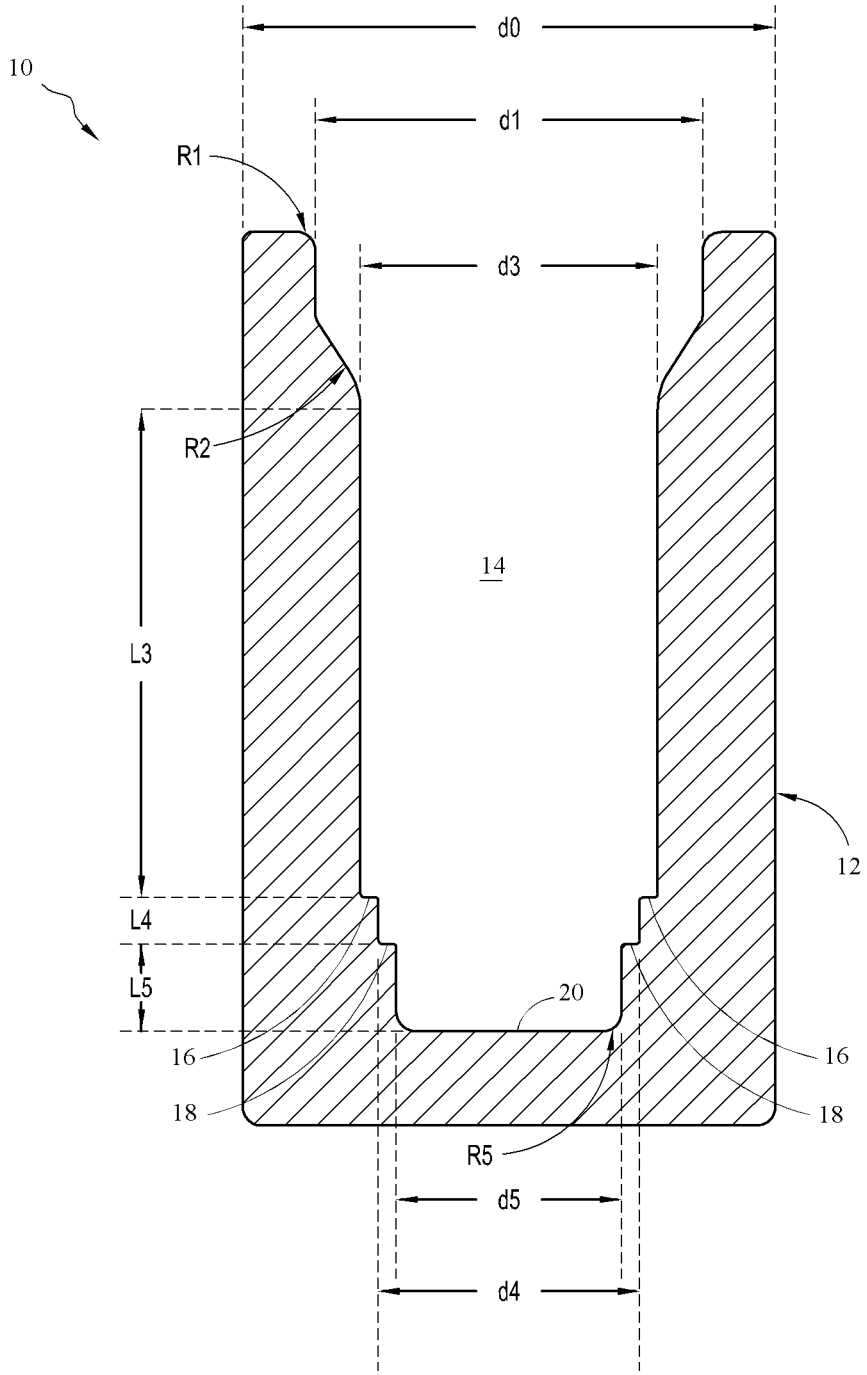
FIG. 2 is a cross-sectional view of a hosel in accordance with at least one embodiment.

With reference to FIGS. 1 and 2, a golf club head can include a hosel 10 that is configured to receive more than one size club head shaft. For example, and with reference to FIG. 1, in some embodiments a hosel 10 can comprise a hosel body 12 and an inner hosel opening 14. The hosel 10 can comprise a first hosel section having an outer diameter d0, an inner diameter d1, and a length L1. In some embodiments, the inner diameter d1 can be greater than the diameter of a remaining portion of the hosel opening 14. In some embodiments the inner diameter d1 can be approximately 10.9 mm, though other ranges and values are also possible. For example, in some embodiments the inner diameter d1 can range from approximately 10 mm to 12 mm. In other embodiments, the inner diameter d1 can range from approximately 9 mm to 13 mm. The inner diameter d1 can be wider than the diameter of a club head shaft to be inserted into the hosel opening 14 so that the club head shaft can be more easily inserted initially into the hosel opening 14. In some embodiments, the first section of the hosel 10 can act as a guide to guide a club head shaft into the hosel opening 14.

With continued reference to FIG. 1, and as described above, the first section of the hosel 10 can have a length L1. The length L1 can be approximately 3.3 mm, though other values and ranges are also possible. For example, in some embodiments the length L1 can range from approximately 3 mm to 4 mm. In other embodiments the length L1 can range from approximately 2.5 mm to 4.5 mm.

In some embodiments, the hosel body 12 can comprise first radius R1 along a top end of the hosel body 12. The radius R1 can be approximately 0.5 mm, though other values and ranges are also possible. For example, in some embodiments the radius R1 can range from approximately 0.4 mm to 0.6 mm. In some embodiments, the radius R1 can range from approximately 0.3 mm to 0.7 mm. The radius R1 can act to further help guide a club head shaft into the hosel opening 14.

With continued reference to FIG. 1, the hosel opening 14 can comprise a second hosel section located below the first hosel section. The second hosel section can have an outer diameter d0, an inner diameter that tapers inwardly from the inner diameter d1, and a length L2. The length L2 can be approximately 2.5 mm, though other values and ranges are also possible. For example, in some embodiments the length L2 can range from approximately 2 mm to 3 mm.

In some embodiments the hosel body 12 can include a second radius R2 located at a bottom of the second hosel section. The second radius R2 can be approximately 4.8 mm, though other values and ranges are also possible. For example, in some embodiments the radius R2 can range from approximately 4 mm to 6 mm. In other embodiments, the radius R2 can range from approximately 3.5 mm to 6.5 mm. The radius R2 can act to further help guide a club head shaft into the hosel opening 14.

With continued reference to FIG. 1, the hosel 10 can form a third hosel section located below the second hosel section. The third hosel section can have an outer diameter d0, an inner diameter d3, and a length L3. The inner diameter d3 can be approximately 9.5 mm, though other values and ranges are also possible. For example, in some embodiments the inner diameter d3 can range from approximately 9 mm to 10 mm. In some embodiments the inner diameter d3 can range from approximately 8.5 mm to 10.5 mm.

In some embodiments, the length L3 can be approximately 12.7 mm to 29.21 mm, though other values and ranges are also possible. For example, in some embodiments the length L3 can range from approximately 10 mm to 35 mm. In some embodiments the length L3 can range from approximately 15 mm to 25 mm.

With continued reference to FIG. 1, the hosel 10 can comprise a fourth hosel section located below the third hosel section. The fourth hosel section can have an outer diameter d0, an inner diameter d4, and a length L4. The inner diameter d4 can be approximately 9.4 mm, though other values and ranges are also possible. For example, in some embodiments the inner diameter d4 can range from approximately 9.2 mm to 9.6 mm. In some embodiments, the inner diameter d4 can range from 9 mm to 9.8 mm. In some embodiments, the inner diameter d4 can be smaller than any other inner diameter that forms the hosel opening 14.

As described above, the fourth hosel section can have a length L4. The length L4 can be approximately 1.3 mm, though other values and ranges are also possible. For example, in some embodiments the length L4 can range from approximately 1.2 mm to 1.4 mm. In some embodiments the length L4 can range from approximately 1.0 mm to 1.5 mm.

In some embodiments, the fourth hosel section can be configured to receive the end of a club head shaft that is smaller in diameter than inner diameter d3. For example, the fourth hosel section can be configured to receive the end of a club head shaft that has a diameter equal to or less than the diameter d4.

In some embodiments, the fourth hosel section can have a radius R4 formed along the hosel body 12. The radius R4 can be approximately 0.25 mm, though other values and ranges are also possible. For example, in some embodiments the radius R4 can range from approximately 0.23 mm to 0.27 mm. In other embodiments, the radius R4 can range from approximately 0.21 mm to 0.29 mm. The radius R4 can act to further help guide a club head shaft into the hosel opening 14.

With continued reference to FIG. 1, in some embodiments the fourth hosel section can be configured to hold an epoxy-like substance. For example, a club head shaft can be inserted into the hosel 10, and can contact a top ledge or surface 16 of the fourth hosel section. Beneath the shaft, the hosel opening 14 can contain an epoxy-like substance so as to help fasten the club head shaft inside the hosel 10. As described further herein, other structures, including but not limited to a plug, can also be used to fill in any gaps located within the hosel opening 14 in the fourth hosel section.

In some embodiments, for example where a shaft diameter is less than the inner diameter d3, a layer of epoxy-like substance can be inserted into the hosel opening 14 and/or applied to the club head shaft. For example, if the club head shaft has a diameter less than inner diameter d3, and the end of the club head shaft sits on a lower ledge 18 of hosel 10, an epoxy (or another suitable substance) can be inserted into the remaining void(s) in the hosel opening 14. The epoxy can help to secure the club head shaft in place within the hosel opening 14.

With reference to FIG. 2, in some embodiments the hosel 10 can include more than two inner diameters d3, d4 in the hosel opening 14 for accepting different sized shafts. For example, in some embodiments the hosel 10 can include a fifth hosel section having an outer diameter d0, an inner diameter d5, and a length L5. In some embodiments the inner diameter d5 can be smaller than both the inner diameters d3 and d4. The inner diameter d5 can be approximately 8.6 mm, though other values and ranges are also possible. For example, in some embodiments the diameter d5 can range from approximately 8.4 mm to 8.8 mm. In other embodiments, the diameter d5 can range from approximately 8.2 mm to 9.0 mm.

As described above, the fifth hosel section can have a length L5 measured from a distal end of the fourth hosel section. The length L5 can be approximately 12.7 mm to 25 mm, though other values and ranges are also possible. For example, in some embodiments the length L5 can range from approximately 10 mm to 30 mm. In some embodiments the length L5 can range from approximately 15 mm to 20 mm.

In some embodiments, the fifth hosel section can have a radius R5 formed along the hosel body 12. The radius R5 can be approximately 0.5 mm, though other values and ranges are also possible. For example, in some embodiments the radius R5 can range from approximately 0.4 mm to 0.6 mm. In some embodiments the radius R5 can range from approximately 0.3 mm to 0.7 mm. The radius R5 can act to further help guide a club head shaft into the hosel opening 14.

The fifth hosel section can be used to receive and/or accommodate a club head shaft. For example, a club head shaft having a diameter equal to or less than d5 can be inserted into hosel opening 14, and the end of the club head shaft can rest on a ledge 20 of the hosel 10. In some embodiments, the ledge 20 can extend along the entire inner diameter d5. In some embodiments, a remaining portion or portions of the hosel opening 14 can be filled, for example, with an epoxy-like substance to help hold the club head shaft in place inside the hosel 10. Thus, at least in some embodiments, the hosel 10 can be configured to receive and accommodate at least three different sized club head shafts, based on the three different inner diameters d3, d4, and d5, and the ledges 16, 18, and 20 described above.

With reference to FIGS. 3-9, in some embodiments a golf club head can additionally, or alternatively, include a hosel spacer 22. The hosel spacer 22 can be used to accommodate multiple sizes of a club head shaft inside a club head.

Figure 3:
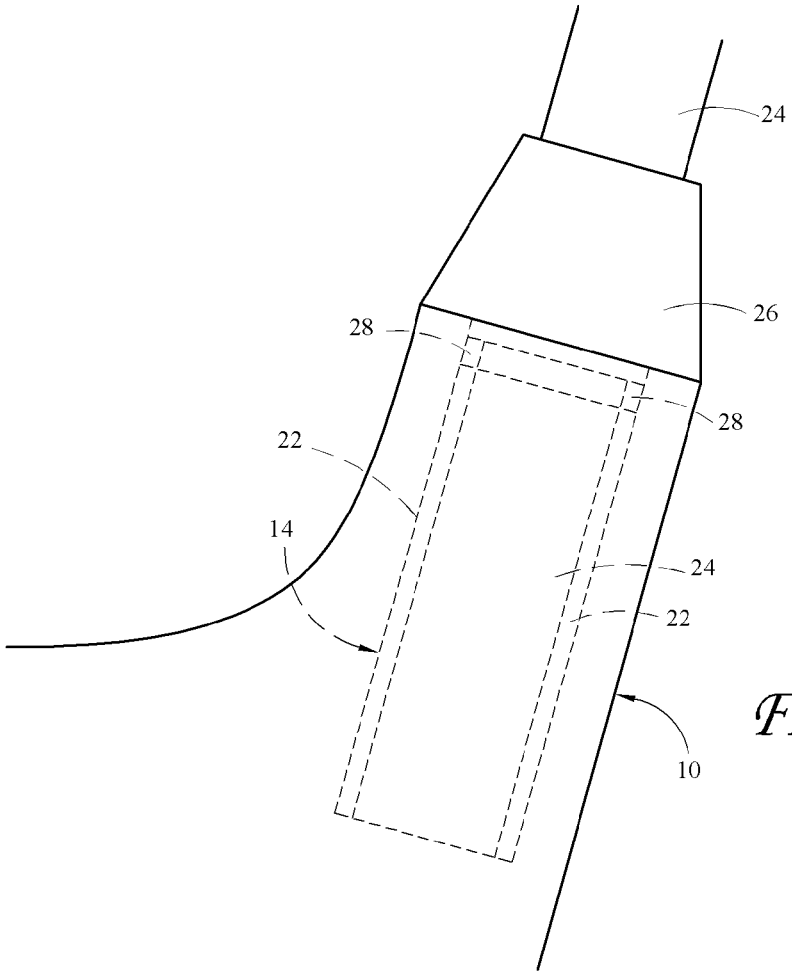
FIG. 3 is a partial front side view of a hosel with a club head shaft, ferrule, and spacer inserted in accordance with at least one embodiment.
Figure 4:
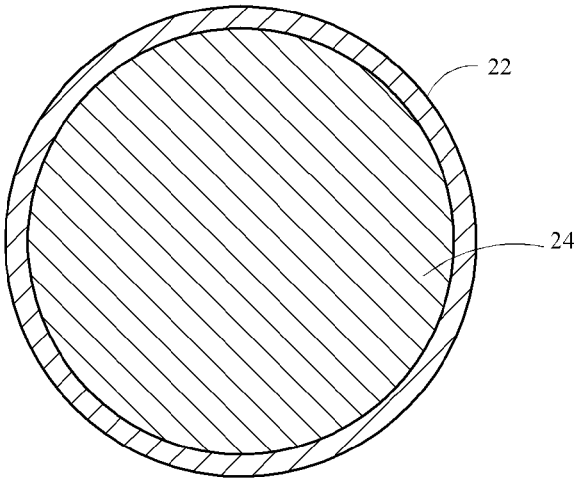
FIG. 4 is a cross-sectional view of the club head shaft and spacer of FIG. 3.
Figure 5:
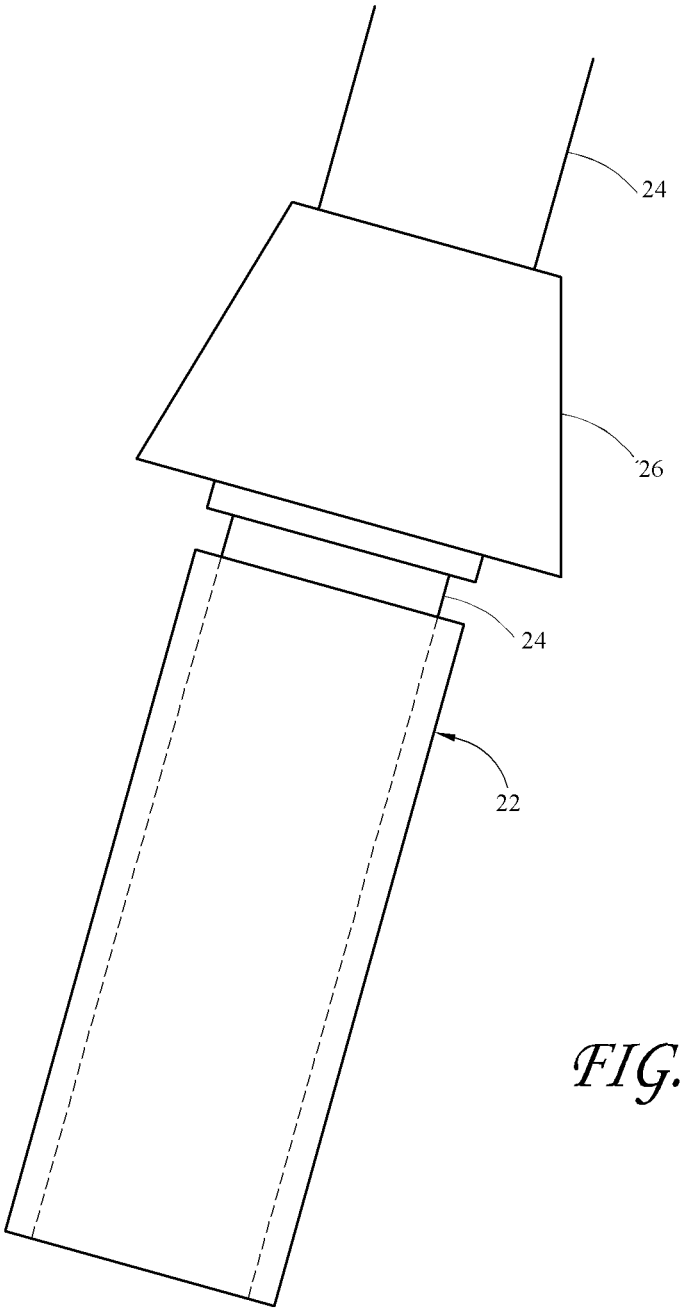
FIG. 5 is a perspective view of the club head shaft, ferrule, and spacer of FIG. 3.

For example, and with reference to FIGS. 3-5, in some embodiments a club head shaft 24 can be inserted through, connected to, and/or or formed with a ferrule 26. The ferrule 26 can be attached to the hosel 10, and/or can form part of the hosel 10. An end of the club head shaft 24 can be inserted into a hosel opening 14 in the hosel 10, for example as seen in FIG. 3, such that the end of the club head shaft 24 is no longer visible from outside the club head. Prior to insertion of the club head shaft 24, the spacer 22 can be attached around the end of the club head shaft 24. In some embodiments, the spacer 22 can be placed inside a hosel opening 14, and the end of the club head shaft 24 can then be inserted into the hosel opening 14. In some embodiments the spacer 22 can be formed as a tube. In some embodiments the spacer 22 can be formed as a sheet, and rolled about an end of the club head shaft 24. In some embodiments, the spacer 22 can be formed similar to a self-expanding stent, and can self-expand within the hosel opening 14. For example, the spacer 22 can be curled, or coiled, about itself, or can be configured to curl or coil, and assume a pre-disposed volume-enlarged shape once released from a volume-reduced shape. Thus, in some embodiments the spacer 22 can be wrapped about the end of the club head shaft 24, held in place and pre-coated with an epoxy, and then inserted with the club head shaft 24 into the hosel 10, where it thereby naturally begins to self-expand and fill in any remaining gaps within the hosel 10.

Without a spacer 22, it can be difficult at times to properly align a club head shaft 24 inside the hosel opening 14 to achieve a desired loft and/or lie angle. This can especially be true if the hosel opening 14 is a simple cylindrical bore hole that is larger than the club head shaft 24, and the club head shaft 24 tilts and/or moves within the hosel opening 14 prior to curing of an epoxy inside the hosel 10. It has been found that bond gaps, which are gaps located between the club head shaft 24 and the inside of the hosel 10 defined by the hosel opening 14, which are greater than about 0.005 inch in width, can cause the epoxy to rapidly lose its effectiveness, and can result in unwanted movement or misalignment of the club head shaft 24. Thus, using a spacer 22 can advantageously reduce the bond gap size inside a hosel 10, and create a more stable environment for aligning a club head shaft 24.

With continued reference to FIGS. 3 and 4, in some embodiments the spacer 22 can comprise a solid material of generally uniform thickness. The spacer 22 can comprise, for example, metallic material (e.g. stainless steel), though other materials are also possible, including non-metallic materials such as plastic. In some embodiments, the spacer 22 can be pre-coated with an epoxy on one or more sides. As described above, in some embodiments epoxy can be used to fill in gaps between the spacer 22 and the inside of the hosel 10. In some embodiments, and with reference to FIG. 3, a separate layer or zone of epoxy 28 can be added in a gap between the top of the spacer 22 and the bottom of the ferrule 26.

In some embodiments, an epoxy-coated spacer 22 can be held or protected prior to curing of the epoxy, so that the spacer 22 can be inserted between the end of the club head shaft 24 and an internal wall of the body of the hosel 10 in the hosel opening 14. Once the club head shaft 24 has been inserted into the hosel opening 14, the epoxy can be cured, for example by heat, light, chemical catalyst, etc., thereby facilitating fastening of the club head shaft 24 to the hosel 10.

In some embodiments, the spacer 22 can be self-adjusting. For example, as described above, the spacer 22 can comprise a self-expanding stent-like device. The spacer 22 can be comprised of flexible and/or compressible material, such that the spacer 22 can expand radially outwardly relative to the club head shaft 24. When the spacer 22 is compressible, if the size of the club head shaft 24 changes, the spacer 22 can still advantageously fill a remaining bond gap inside the hosel 10.

In some embodiments the spacer 22 can have varying lengths. For example, in some embodiments the spacer 22 can extend nearly the entire distance between a top of the hosel opening 14 and a bottom of the hosel opening 14. In some embodiments, the spacer 22 can extend approximately half of the length between a top of the hosel opening 14 and the bottom of the hosel opening 14. In some embodiments, the spacer 22 can extend past the tip of the club head shaft 24.

Figure 6:
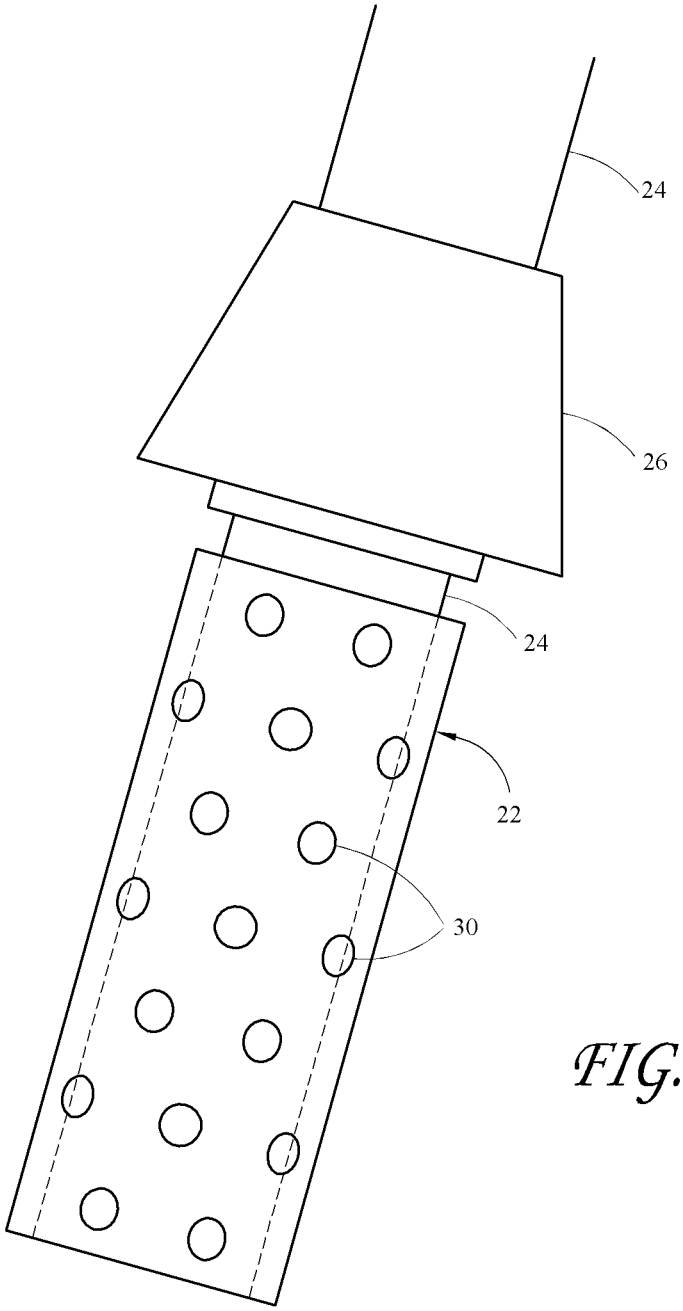
FIG. 6 is a perspective view of a club head shaft, ferrule, and perforated spacer in accordance with at least one embodiment.

With reference to FIG. 6, in some embodiments the spacer 22 can include one or more perforations 30. The perforations 30 can be circular and/or have other shapes. The perforations 30 can extend partially or entirely through a thickness of the spacer 22. In some embodiments the perforations 30 can be spread out generally evenly across the spacer 22. The perforations 30 can be used, for example, to hold additional epoxy-like substance, or other material, and to facilitate bonding between the club head shaft 24 and the hosel 10 so that the club head shaft 24 is in a desired position and/or orientation, and can be fastened securely to the club head.

Figure 7:
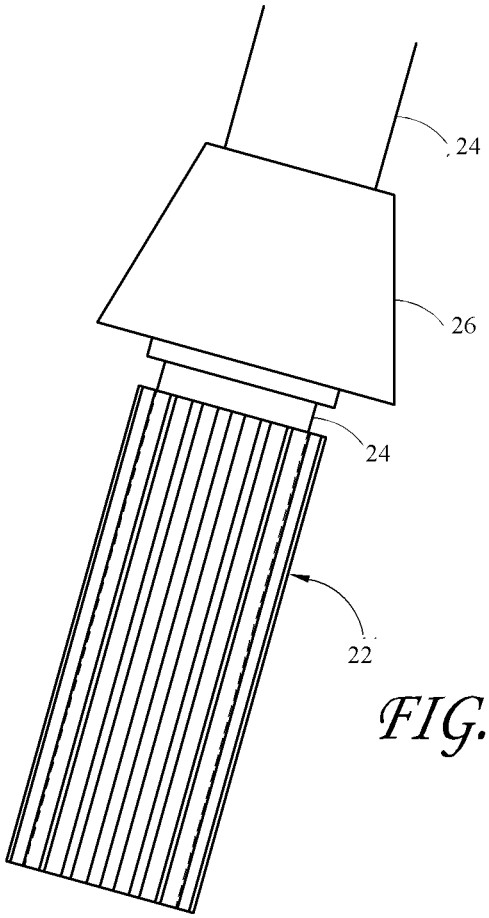
FIG. 7 is a perspective view of a club head shaft, ferrule, and corrugated spacer in accordance with at least one embodiment.
Figure 8:
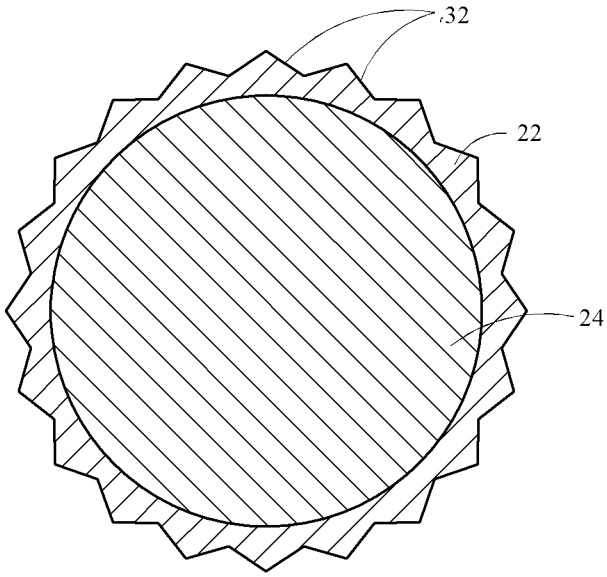
FIG. 8 is a cross-sectional view of the club head shaft and corrugated space of FIG. 7.

With reference to FIGS. 7 and 8, in some embodiments the spacer 22 can have a corrugated shape. For example, the spacer 22 can include multiple ridges 32. As the spacer 22 and/or club head shaft 24 are inserted into the hosel opening 14, the spacer 22 can bend about the ridges 32, and adjust in size to fit within and spread out inside the hosel opening 14, thereby filling in any bond gaps inside the hosel opening 14. In some embodiments, spaces created between each of the ridges 32 can be filled with epoxy-like substance to help facilitate bonding between the club head shaft 24 and the hosel 10, so that the club head shaft 24 is in a desired position and/or orientation, and can fastened securely to the club head.

Figure 9:
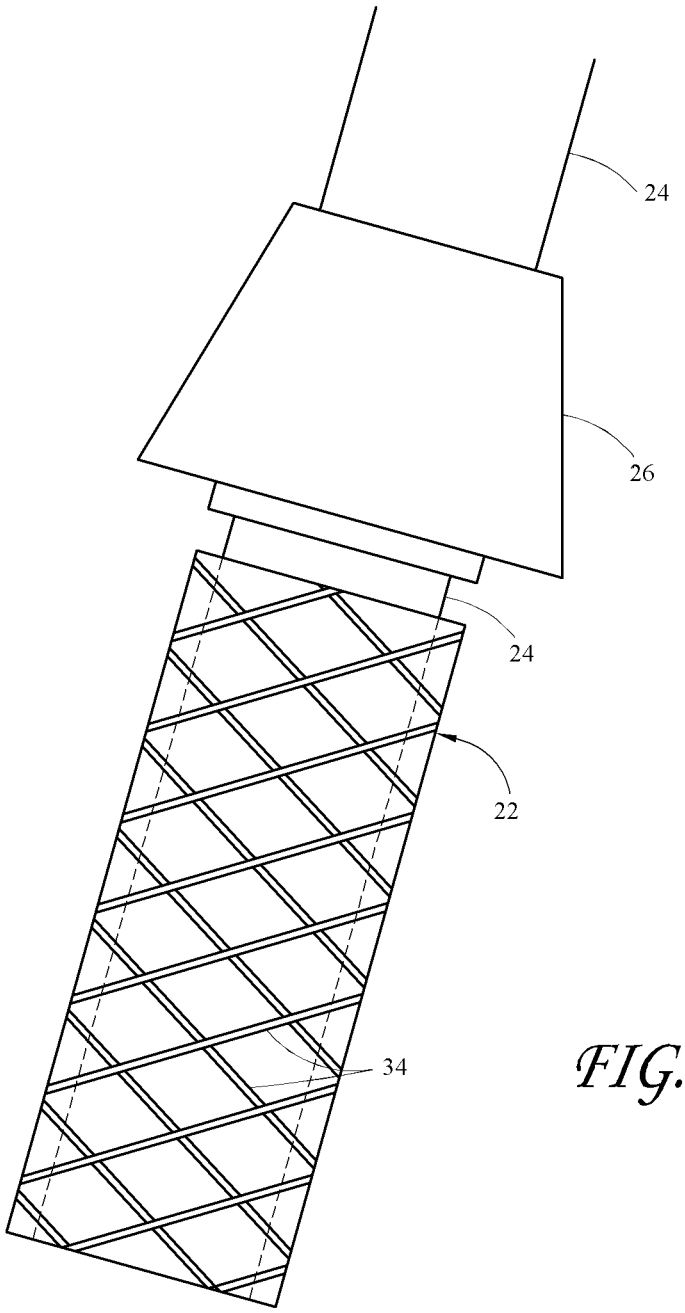
FIG. 9 is a perspective view of a club head shaft, ferrule, and mesh spacer in accordance with at least one embodiment.

With reference to FIG. 9, in some embodiments the spacer 22 can have a mesh-like configuration. For example, the spacer 22 can have a plurality of mesh-like elements 34 that are braided, woven, laser-cut, etc. As with the perforated version of spacer 22, a mesh-like version of spacer 22 can provide areas for insertion of additional epoxy-like substance between the mesh elements 34 to help facilitate bonding between the club head shaft 24 and the hosel 10, so that the club head shaft 24 is in a desired position and/or orientation, and can be fastened securely to the club head. Additionally, in some embodiments the mesh elements 34 can facilitate self-adjustment of the spacer 22, particularly if the mesh elements 34 are self-expanding in nature. For example, in some embodiments once the mesh-like spacer 22 has been inserted into a hosel opening 14, the mesh elements 34 can naturally expand to fill bond gaps in the hosel opening 14.

Figure 10A:
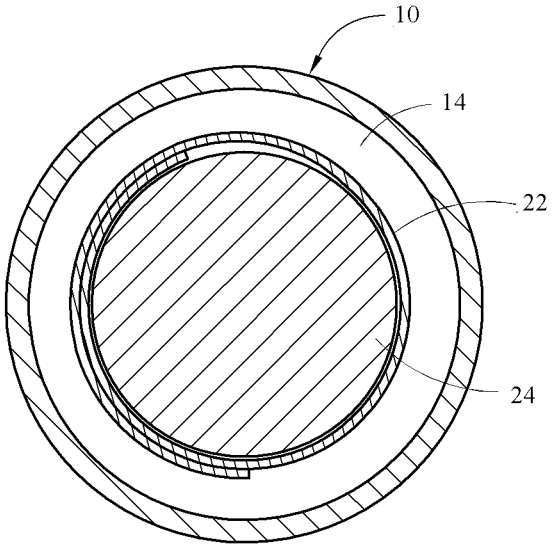
FIGS. 10A and 10B are cross-sectional views of a club head, illustrating the expansion of a spacer within a hosel in accordance with at least one embodiment.
Figure 10B:
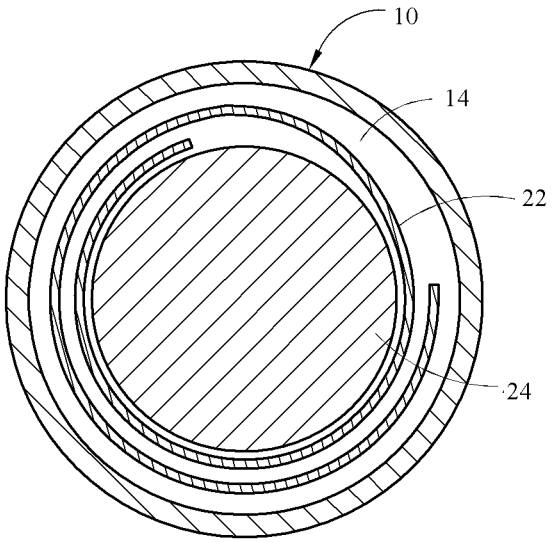

With reference to FIGS. 10A and 10B, and as described above, in some embodiments the spacer 22 can be configured to self-expand within a hosel opening 14, thereby filling in bond gaps. FIGS. 10A and 10B illustrate an embodiment of the effect of self-expansion, with FIG. 10A showing a first state of expansion, and FIG. 10B showing a second state of expansion of a spacer 22.

The self-expanding nature of the spacer 22, along with its ability to retain predetermined amounts of adhesive for dispersal within the hosel opening 14, can advantageously permit the spacer 22 to be used with a variety of different hosel openings 14, and further to be used for example with the universal hosels described above and illustrated in FIGS. 1-3. For example, while the embodiments of the spacer 22 illustrated in FIGS. 3-10 and described above are illustrated in the context of using the spacer 22 in a single diameter, cylindrical hosel opening 14, the spacers 22 can also be used within a stepped, universal-type hosel 10 like that illustrated in FIGS. 1-3.

Overall, inserting a hosel spacer 22 can be an efficient way to both reduce gaps and create a snug fit between the club head shaft 24 and the internal walls of the hose 10, as well as to self-dispense epoxy within the hosel 18. In some embodiments, and as described above, the structure of the spacer 22 can be pre-coated with an epoxy for precision in self-dispensing a proper amount of epoxy within the hosel 10. It has been found that an optimum thickness (i.e. thickness extending in a radial direction inside the hosel 10) for the coating of epoxy on a spacer 22 can range from between 0.001 to 0.003 inches, though other ranges and values are also possible. In some embodiments a spacer 22 can be pre-coated with a thickness of expoxy that ranges from 0.0005 to 0.0035 inches. It has been found in some embodiments that if the epoxy thickness is greater than 0.003 inches, the epoxy can lose its strength. Therefore, at least in some embodiments, the epoxy thickness can be less than 0.003 inches.

Another advantage of a spacer 22 is that the pre-dispensed epoxy on the spacer 22 can be better for the environment and safer for the environment, since there is minimal, if any, waste of epoxy. In contrast, when epoxy is added after a spacer 22 has been inserted, it can be easy to inadvertently use more epoxy than is necessary, and/or to thereby create a product that will cause greater harm to the environment than necessary.

Additionally, in some embodiments, a lattice-like structure on a spacer 22 can allow the spacer 22 to be more light-weight than other spacers, thereby reducing cost and time in manufacturing. The light-weight, latticed nature of a spacer 22 can make it easier to sell and ship the spacers 22, and can further make it easier to apply the epoxy or other types of adhesive directly onto the spacer.

Furthermore, by using the universal hosel and/or spacers described above, a hosel opening 14 can self-center a multitude of shaft sizes consistently and accurately. To manage issues of slop (i.e. excess epoxy or other material that may drip to the bottom of a hosel opening 14), in some embodiments, and as described above, a plug or some other structure can be inserted at the bottom of the hosel opening 14. The plug other structure can comprise a structure that is light and has a minimal rigidity. In some embodiments, the addition of this plug or other structure can provide vibration damping benefits to the club head.

The universal hosel and/or spacer 10, 22 described above can be used to accommodate ease of transition between certain clubs and club sets. For example, an iron set and hybrid set can include the same universal hosel and/or set of spacers, thereby making it easy to switch out club head shafts and transition from one type of club head to another. The universal hosel and/or spacer can offer a level of both precision and efficiency in accommodating club head shafts that is not found in current club heads. By using the universal hosel and/or spacer, the club heads of a particular set (e.g. an iron set, wood set, hybrid set, etc.), or of an entire set, can be manufactured to have the same pre-drilled dimensions to receive a variety of different club head shafts 24. Thus, the universal hosel and/or spacer can be used to reduce the need to specially bore out specific dimensions for specially made club head shafts 24.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A golf head comprising:

a ball striking face;

a sole;

a crown;

a hosel comprising:

a first hosel section comprising a first outer diameter, a first inner diameter, and a first length;

a second hosel section located below the first hosel section, the second hosel section comprising a second outer diameter, a second inner diameter tapered inwardly from the first inner diameter, and a second length;

a third hosel section located below the second hosel section, the third hosel section comprising a third outer diameter, a third inner diameter less than the first inner diameter, and a third length;

a fourth hosel section located below the third hosel section, the fourth hosel section comprising a fourth outer diameter, a fourth inner diameter less than the third inner diameter, and a fourth length, the fourth hosel section further comprising a first upper ledge configured to support the end of a club head shaft;

a fifth hosel section located below the fourth hosel section, the fifth hosel section comprising a fifth outer diameter, a fifth inner diameter less than the fourth inner diameter, and a fifth length, the fifth hosel section comprising a second upper ledge configured to support the end of a club head shaft; and a third lower ledge configured to support the end of a club head shaft.

2. The golf club head of claim 1, wherein the first inner diameter is between approximately 9.0 mm to 13.0 mm, and the first length is between approximately 2.5 mm to 4.5 mm.

3. The golf club head of claim 1, wherein the third inner diameter is between approximately 8.5 mm to 10.5 mm, and the third length is between approximately 12.7 mm to 29.2 mm.

4. The golf club head of claim 1, wherein the fourth inner diameter is between approximately 9.0 mm to 9.8 mm, and the fourth length is between approximately 1.0 mm to 1.5 mm.

5. The golf club head of claim 1, wherein the fifth inner diameter is between approximately 8.4 mm and 8.8 mm, and the fifth length is between approximately 12.7 mm and 25.0 mm.

6. The golf club head of claim 1, wherein the lower ledge extends across the entire fifth inner diameter.

7. The golf club head of claim 1, further comprising a club head shaft having an end located within the hosel, the end of the club head shaft having a diameter less than the third inner diameter and greater than the fifth inner diameter.

8. The golf club head of claim 1, further comprising a club head shaft having an end located within the hosel, the end of the club head shaft having a diameter less than the third inner diameter, less than the fourth inner diameter, and no greater than the fifth inner diameter.

9. The golf club head of claim 1, further comprising a club head shaft having an end located within the hosel, the end of the club head shaft having a diameter less than the third inner diameter, and an epoxy-like substance located within the hosel between the club head shaft and an inner wall forming the third inner diameter.

* * * * *